US005231961A

United States Patent [19]

Shimada et al.

[11] Patent Number: 5,231,961

[45] Date of Patent: Aug. 3, 1993

[54] CAMSHAFT AND ACCESSORY DRIVE ARRANGEMENT FOR ENGINE

[75] Inventors: Kazuo Shimada; Tatsuo Niiyama; Tetsushi Saito, all of Iwata, Japan

[73] Assignee: Yamaha Hatsudoki Kabushiki Kaisha, Iwata, Japan

[21] Appl. No.: 467,783

[22] Filed: Jan. 19, 1990

[30] Foreign Application Priority Data

Jan. 19, 1989 [JP] Japan ..... 1-10183

[51] Int. Cl.[5] ..... F01L 1/02

[52] U.S. Cl. ..... 123/90.27; 123/41.44

[58] Field of Search ..... 123/41.44, 41.46, 55 VS, 123/55 VF, 55 VE, 90.27, 90.31, 195 A, 195 E, 198 R, 198 C, 196 R

[56] References Cited

U.S. PATENT DOCUMENTS 2,479,617 8/1949 Hawley et al. ..... 123/90.31

4,821,684 4/1989 Tasaka ..... 123/198 R

FOREIGN PATENT DOCUMENTS 144614 8/1983 Japan ..... 123/90.31

*Primary Examiner*—Noah P. Kamen

*Attorney, Agent, or Firm*—Ernest A. Beutler

[57] ABSTRACT

An improved camshaft and accessory drive arrangement for a V type engine wherein pairs of overhead cams are driven from the crankshaft by means of intermediate shafts that are directly driven by the crankshaft. The axis of rotation of the intermediate shafts is disposed closer to the axis of rotation of the crankshaft than the axes of rotation of the camshafts. An accessory is positioned in the valley of the V and is also driven by the crankshaft but is spaced further from the crankshaft axis of rotation than the intermediate shafts. This accessory is a water pump and an oil pump is also driven by the crankshaft at the same end of the engine.

10 Claims, 9 Drawing Sheets

CAMSHAFT AND ACCESSORY DRIVE ARRANGEMENT FOR ENGINE

BACKGROUND OF THE INVENTION

This invention relates to a camshaft and accessory drive for an engine and more particularly to an improved camshaft and accessory drive arrangement for V-type engines.

The advantages of employing overhead camshafts for operating overhead mounted valves are well known. Although the engine performance can be improved by such arrangements, the use of overhead camshafts and the drives therefor can present certain problems, particularly when the engine must operate in a relatively confined area, as is the conventional practice in motor vehicles. That is, in addition to driving the camshaft or camshafts from the engine crankshaft, there are normally incorporated a number of accessories such as water pumps, oil pumps and the like that are also driven from the engine crankshaft. It has been generally the practice to locate all of the accessory drives at one end of the engine for simplicity and for ease of servicing. However, when all of the drives are located at one end of the engine, the positioning of the various drives for the different devices can substantially add to the length of the engine.

In connection with engines of the type described, they operated generally on the four-stroke principle. As a result, the camshaft or camshafts must be driven at one-half the speed of the crankshaft. This necessitates the provision of some form of speed reduction between the crankshaft and camshafts which can further aggravate the aforenoted problems.

Furthermore, it has been generally the practice to employ flexible transmitters for driving the camshaft or camshafts from the crankshaft. Such flexible transmitters can take the form of either belts or chains. In either event, it is also desirable to maintain a relatively short length for the flexible transmitter so as to minimize the problems in connection with stretch and/or vibrations which can occur due to changes in engine speed and the pulsations which occur in the power output. Therefore, it has also been proposed to employ a form of intermediate shaft which is driven from the engine crankshaft and which, itself, drives the camshaft or camshafts. However, such intermediate shafts further increase the complexity of the accessory drive for the engine.

All of the aforenoted problems are still further compounded when the engine is of the type having angularly related cylinder banks such as opposed or V-type engines. Obviously, the use of flexible transmitters for driving the camshafts of angularly disposed cylinder banks further magnify the aforenoted problems.

It is, therefore, a principal object of this invention to provide an improved, simplified and compact camshaft drive arrangement for an internal combustion engine.

It is a further object of this invention to provide an improved, compact camshaft drive arrangement for an internal combustion engine of the type having angularly disposed cylinder banks.

It is yet a further object of this invention to provide a camshaft and accessory drive arrangement for an internal combustion engine wherein the camshaft and accessories can be driven from one end of the engine without significantly adding to the length of the engine.

It is a further object of this invention to provide an improved, compact camshaft and accessory drive arrangement for an engine of the type having angularly disposed cylinder banks and incorporating intermediate shafts for driving the camshafts from the crankshaft.

SUMMARY OF THE INVENTION

A first feature of this invention is adapted to be embodied in an internal combustion engine having a cylinder block with at least one cylinder bore and a piston reciprocating in the cylinder bore. A crankshaft is journaled for rotation about an axis at one end of the cylinder bore and is driven by the piston. A cylinder head is affixed relative to the cylinder block and closes the other end of the cylinder bore. A camshaft is journaled for rotation relative to the cylinder head and operates at least one valve positioned therein. An intermediate shaft is driven from the crankshaft at one end of the engine and the camshaft is driven from the intermediate shaft. An accessory having an input shaft is also driven from the crankshaft at the one end of the engine. In accordance with this feature of the invention, the intermediate shaft is positioned closer to the crankshaft than is the input shaft of the driven accessory.

Another feature of the invention is adapted to be embodied in an engine having a pair of angularly disposed cylinder banks each having a cylinder head with a respective camshaft rotatably journaled therein. The cylinder banks drive a crankshaft that is rotatably journaled about an axis. A pair of intermediate shafts are driven by first flexible transmitted means from the crankshaft. A second pair of flexible transmitter means is provided for driving the camshaft of each cylinder head from a respective one of the intermediate shafts. In accordance with this feature of the invention, the axis of rotation of the intermediate shafts is disposed closer to the axis of rotation of the crankshaft than to the axis of rotation of the camshafts.

DETAILED DESCRIPTION OF THE PREFERRED EMBODIMENT

Figure 1:
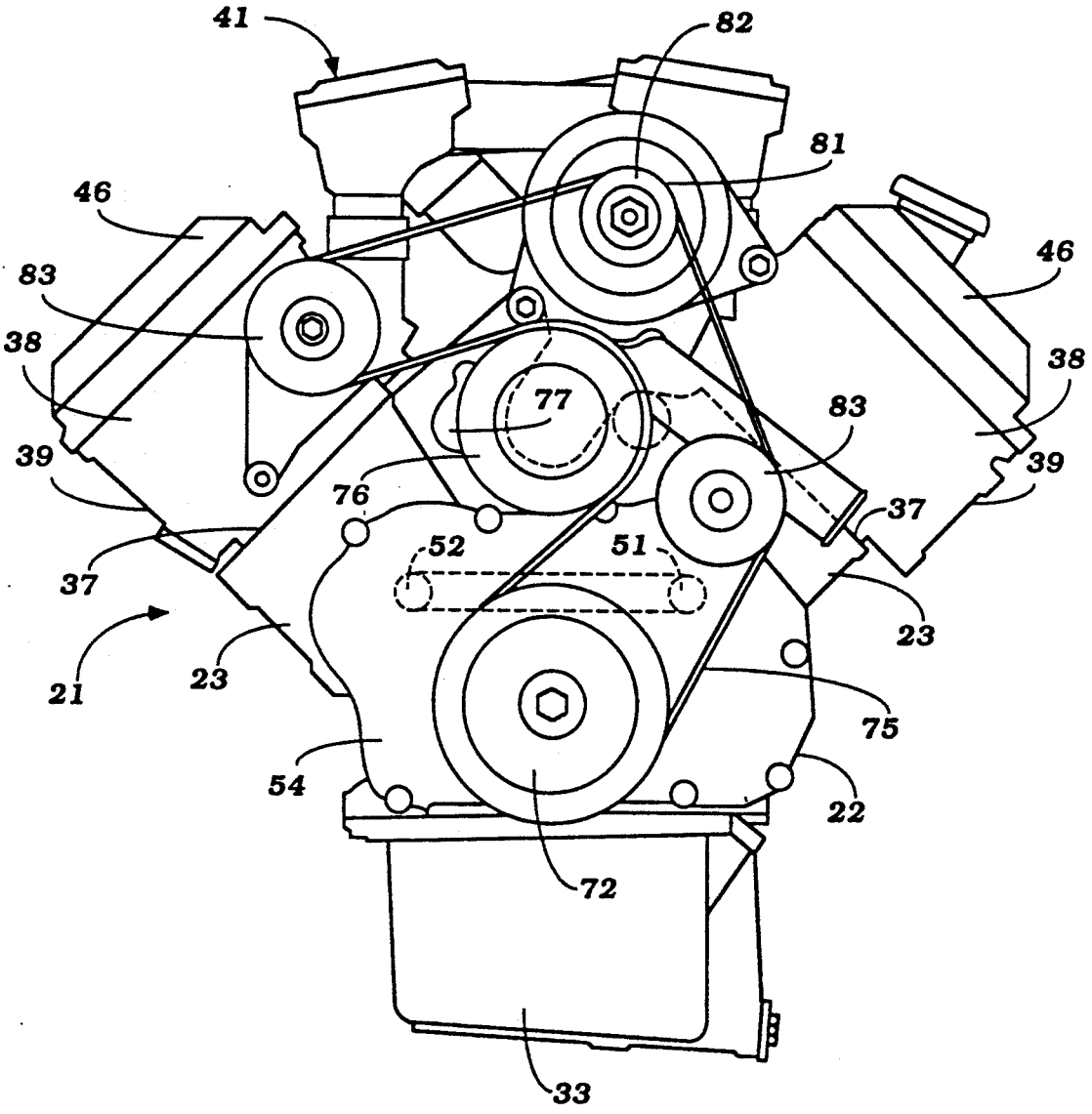
FIG. 1 is a front elevational view of an internal combustion engine constructed in accordance with an embodiment of the invention.

Referring first generally to FIG. 1, an internal combustion engine constructed in accordance with an embodiment of the invention is identified generally by the reference numeral 21. In the illustrated embodiment, the engine 21 is of the 90° V8 type and operates on a four-stroke cycle. It is to be understood, however, that the invention may be utilized in conjunction with other types of engines having other cylinder numbers and other cylinder configuration. However, the invention has particularly utility in conjunction with engines having angularly disposed cylinder banks and particularly those which are arranged in a V pattern.

Figure 3:
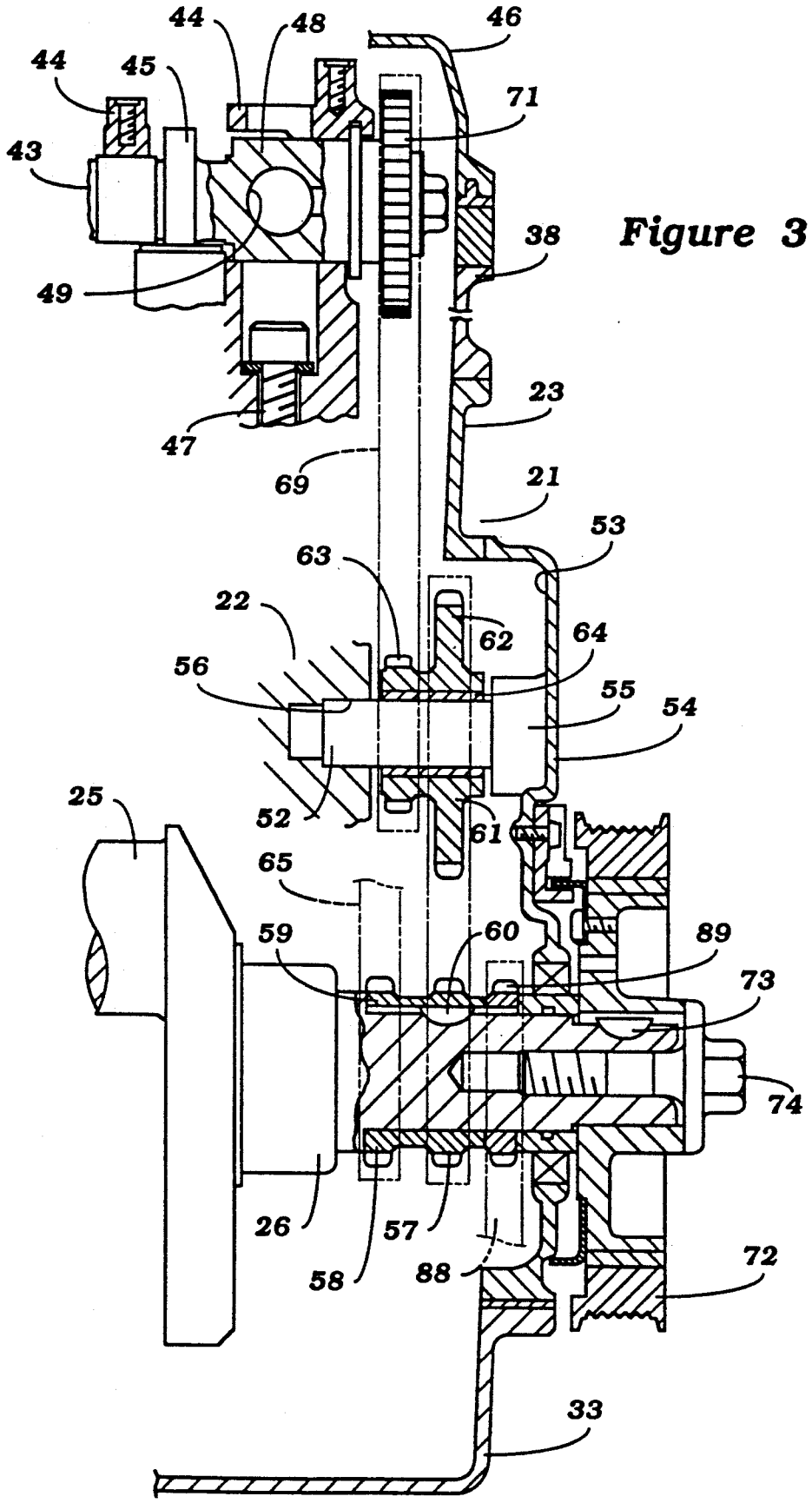
FIG. 3 is a further enlarged cross-sectional view taken generally along the line 3—3 of FIG. 2.
Figure 10:
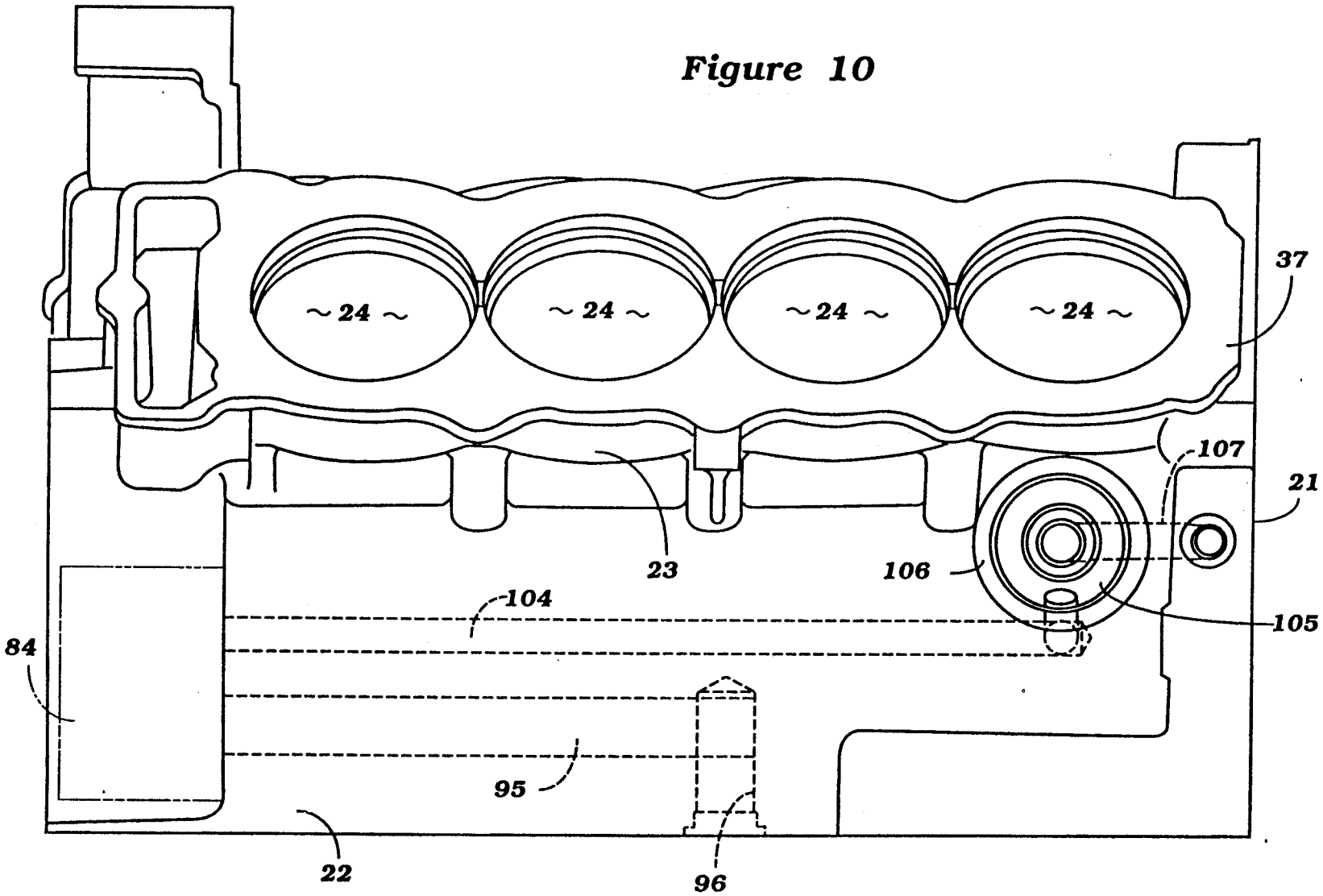
FIG. 10 is a side elevational view of the cylinder block looking from the oil pump side.

The engine 21 is comprised of a cylinder block 22 that has a pair of angularly disposed cylinder banks 23 each of which is formed with four cylinder bores 24 (FIG. 10). Pistons (not shown) reciprocate in the cylinder bores 24 and are connected by means of connecting rods (also not shown) in side-by-side fashion to individual throws 25 of a crankshaft 26 (FIG. 3). As is typical with V-type engines, the cylinder bores 24 of the cylinder banks 23 are staggered with respect to each other so as to provide an offset so that the connecting rods of the individual cylinders of the banks may be journaled in side-by-side fashion on the throws 25 of the crankshaft 26 in a known manner.

Figure 7:
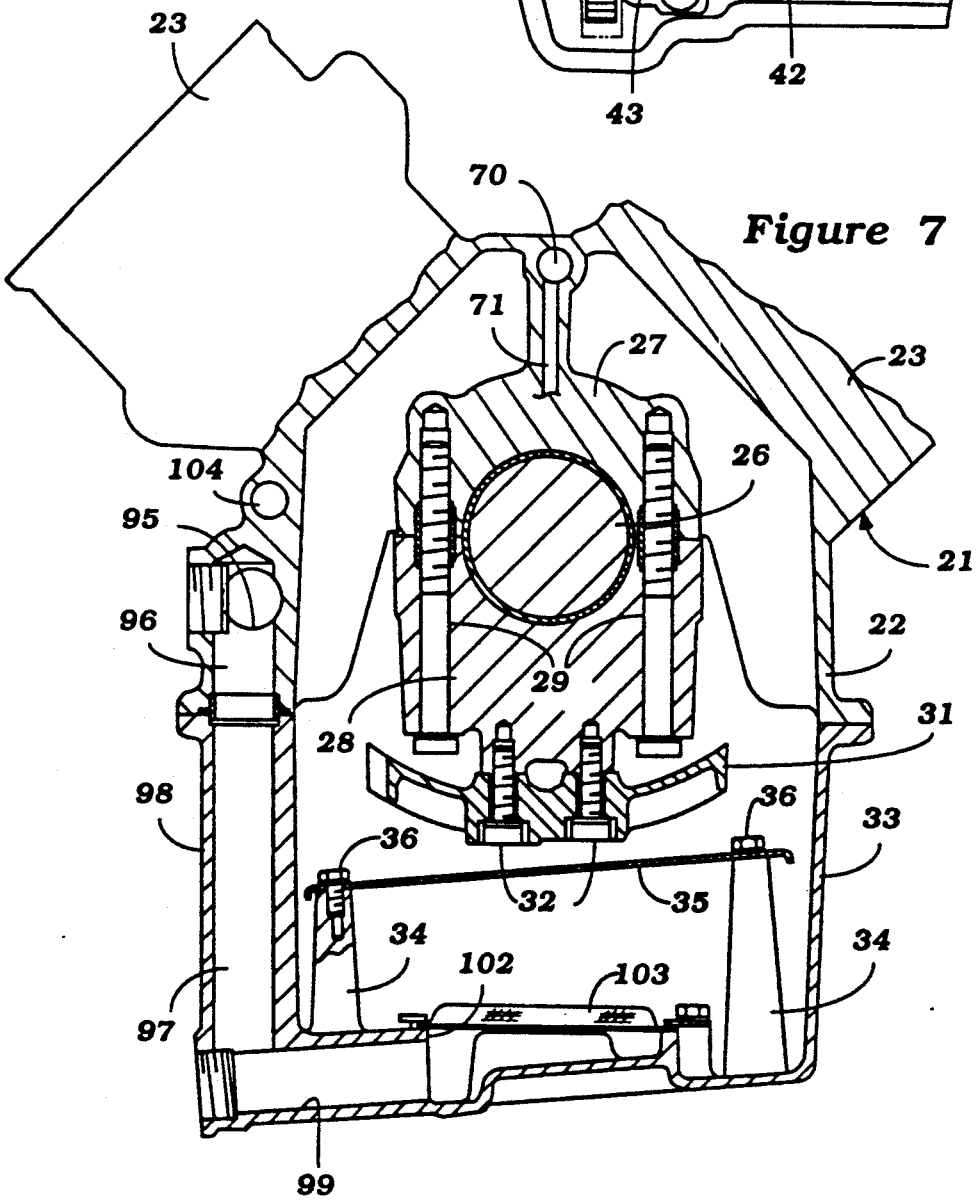
FIG. 7 is a cross-sectional view taken through the crankshaft of the engine at the point where the oil pickup is disposed.
Figure 8:
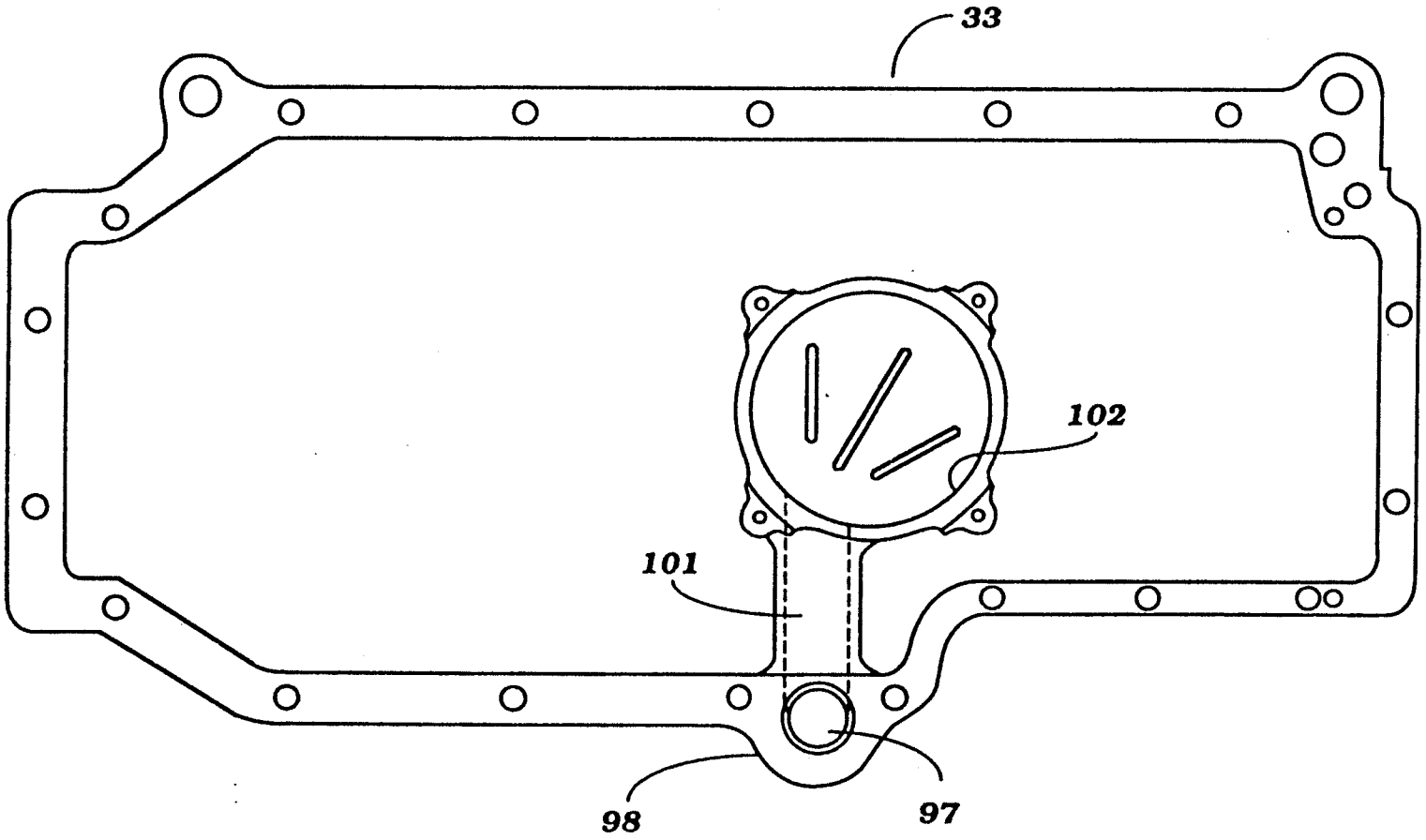
FIG. 8 is a top plan view showing the oil pan with the baffle plate removed.
Figure 9:
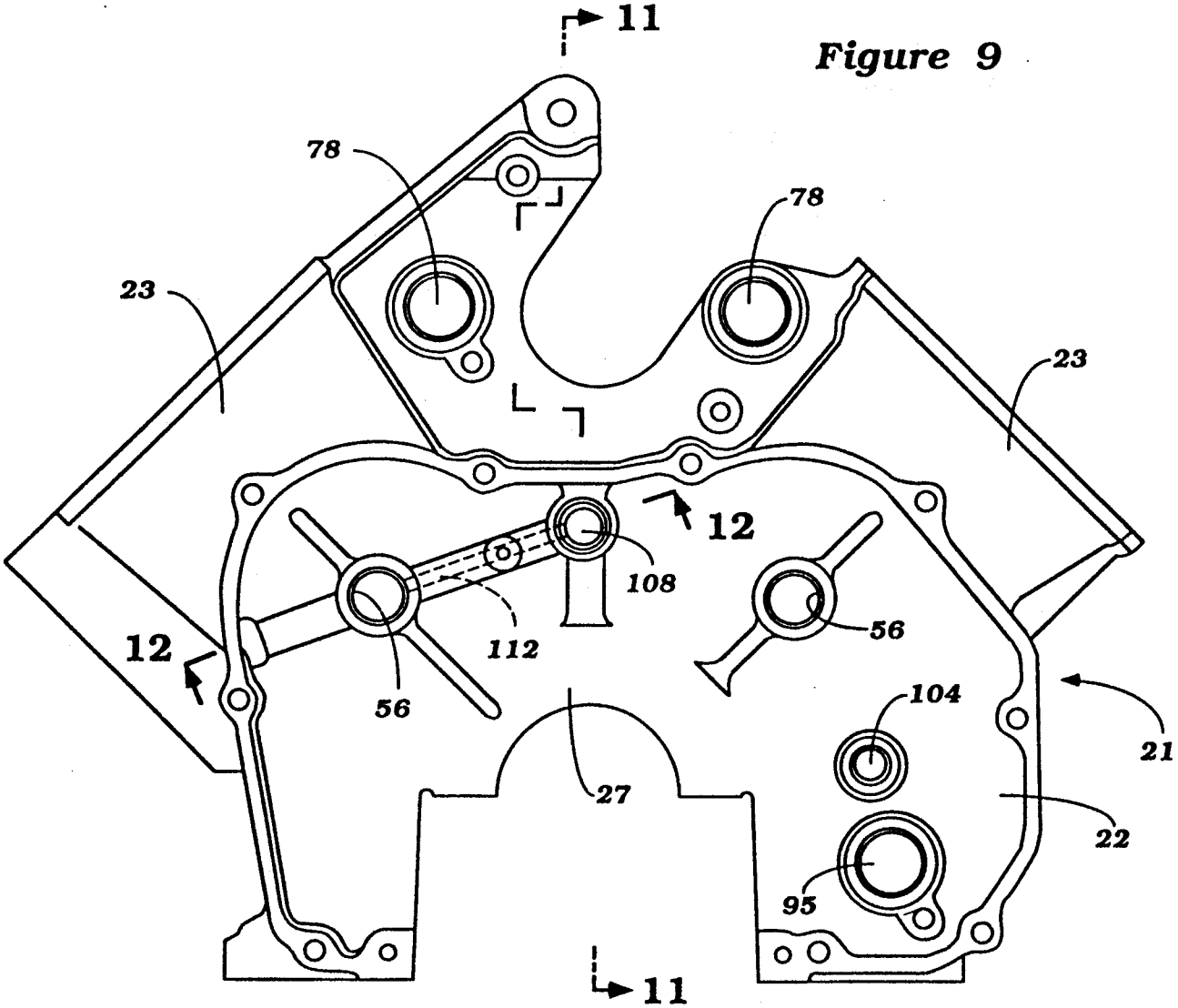
FIG. 9 is a front elevational view of the cylinder block.
Figure 11:
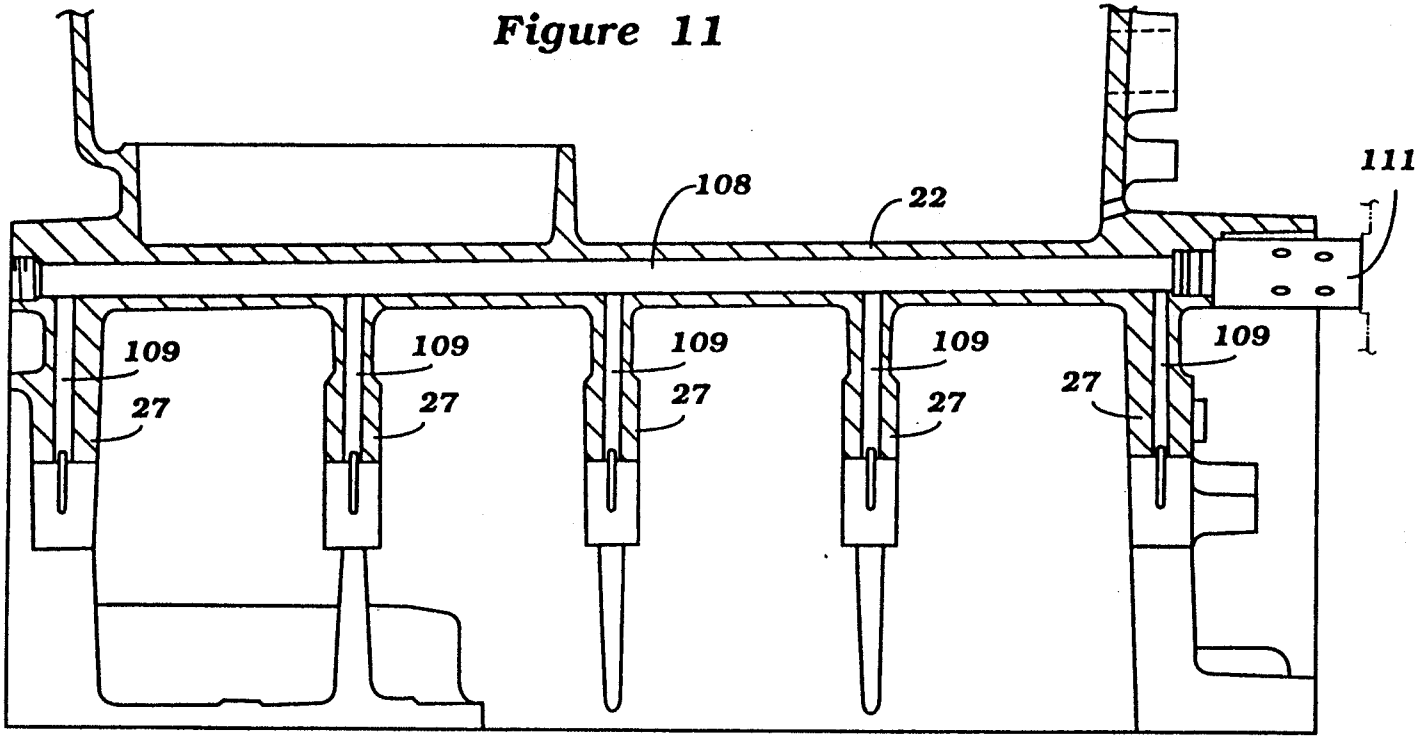
FIG. 11 is a cross-sectional view taken along the line 11—11 in FIG. 9.
Figure 12:
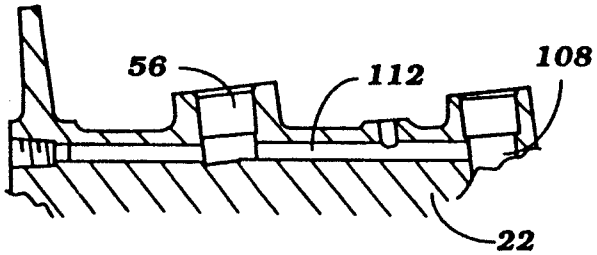
FIG. 12 is a cross-sectional view taken along the line 12—12 in FIG. 9.

As may be best seen in FIGS. 7, 9 and 11, the cylinder block 22 is formed with individual main bearing webs 27 that define bearing portions for receiving bearing inserts (not shown) so as to journal the crankshaft 26. Bearing caps 28 are affixed to the webs 27 by means of fasteners 29. A reinforcing web or beam 31 is affixed to the bearing caps 28 by means of fasteners 32 for the purpose of adding stiffness to the assembly. A crankcase 33 is affixed to the underside of the cylinder block 22 and defines an oil reservoir. As may be best seen in FIG. 7, the crankcase 33 is formed with upstanding bosses 34 to which a baffle plate 35 is affixed by means of fasteners 36.

Figure 6:
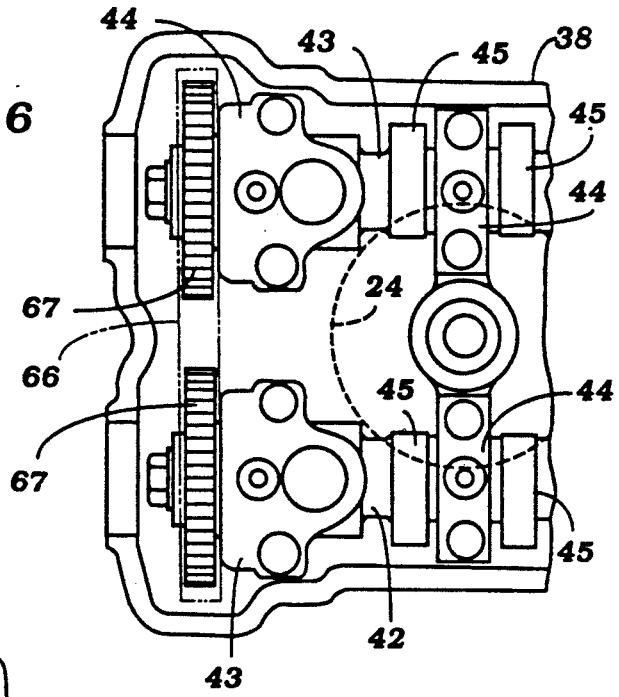
FIG. 6 is a top plan view showing the camshaft support for one of the cylinder banks with the cam cover removed.

The cylinder banks 23 each have respective upper decks 37 to which cylinder heads 38 (FIGS. 1, 2 and 6) are affixed in a known manner. The cylinder heads 38 are formed with combustion chamber recesses that cooperate with the cylinder bores 24 and pistons to form the combustion chambers of the engine. Exhaust ports (not shown) extend through the exhaust or outer sides 39 of the cylinder heads 38 for discharging the exhaust gases to the atmosphere through an appropriate exhaust system (not shown). In addition, there are intake passages formed on the inner or valley side of the cylinder heads 38 that receive a fuel/air charge from an induction system, indicated generally by the reference numeral 41 (FIG. 1). Intake and exhaust valves (not shown) control the flow through the intake and exhaust passages just described.

The intake and exhaust valves are operated by means of respective intake camshafts 42 and exhaust camshafts 43 which are journaled on the cylinder heads 38 in an appropriate manner by means of bearings formed integrally with the cylinder heads 38 and cooperating bearing caps 44. The camshafts 42 and 43 are formed with lobes 45 for operating the valves in a known manner. Since the valve structure and its operation forms no part of the invention, this construction has not been illustrated. The invention, however, deals with the manner in which the camshafts 42 and 43 are driven as well as the manner in which various accessories of the engine, to be described, are driven. Cam covers 46 are affixed to the cylinder heads 38 in a known manner and enclose the valve operating mechanism.

As may be best seen in FIG. 3, certain of the cylinder head hold-down bolts 47 underlie bearing portions 48 of the camshafts 42 and 43. Clearance holes 49 are formed in these bearing portions and in the bearing caps 44 so that the hold-down fasteners 47 may be tightened as described in U.S. Letters Patent No. 4,430,968, issued Feb. 14, 1984, and assigned to the assignee of this invention, now Re. 32,582. The timing arrangement for the camshafts 42 and 43 is set so that when the timing is correct, the clearance holes 49 extend parallel to the axes of the cylinder bores 24 and the fasteners 47 will be readily accessible under this condition.

Figure 4:
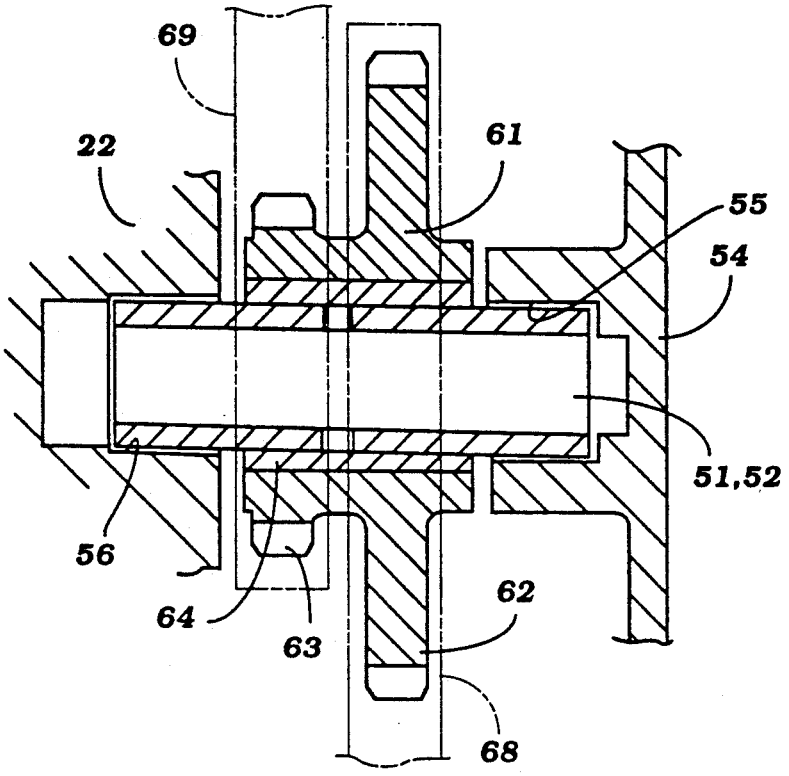
FIG. 4 is a further enlarged cross-sectional view showing the support arrangement for one of the intermediate shafts.
Figure 5:
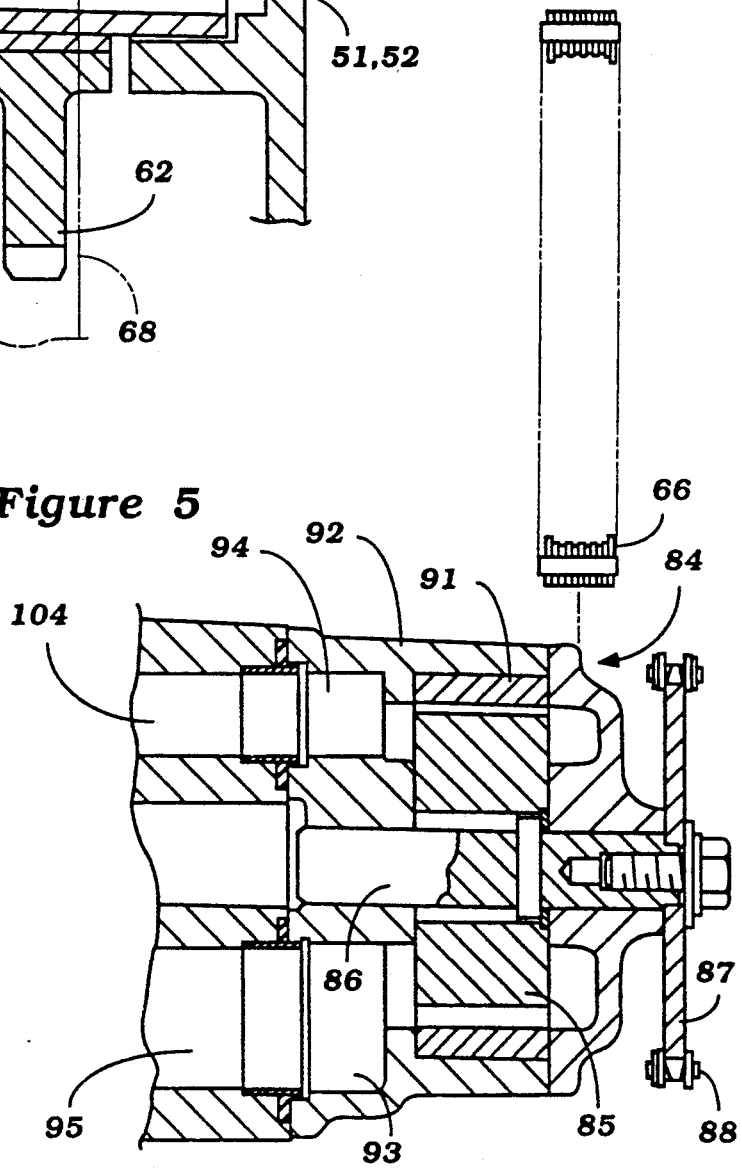
FIG. 5 is a cross-sectional view taken along the line 5—5 of FIG. 2 and is further enlarged.

As is well known, since the engine 21 operates on the four-stroke cycle, the camshafts 42 and 43 should be driven at one-half of crankshaft speed. This is normally done through a single reduction unit which may comprise either a gear set or a flexible transmitter such as a belt or chain. In accordance with the invention, however, an improved arrangement is provided for driving the camshafts 42 and 43 of each cylinder bank 23 from the crankshaft 26 that includes a pair of intermediate shafts 51 and 52 that are journaled within a timing case formed by a recess 53 in the front of the cylinder block 22 and a front cover 54. As may be best seen in FIGS. 3 and 4, each of the shafts 51 and 52 is received in a bore 55 formed in the front cover 54 and a corresponding bore 56 formed in the front of the crankcase 22. The shafts 51 and 52, therefore, define rotational axes $X_2$ that are spaced from the rotational axis $X_1$ of the crankshaft 26 at a fairly close distance.

A pair of axially spaced drive sprockets 57 and 58, which may be formed as a unitary sprocket assembly 59, are keyed for rotation with the crankshaft 26 by means of a key 60 (FIG. 3). Journaled on the shafts 51 and 52 are compound sprocket assemblies, indicated generally by the reference numeral 61, which includes a first sprocket 62 and a second sprocket 63. An interposed bushing 64 rotatably journals the compound sprocket 61 on the respective shaft 51 or 52.

Figure 2:
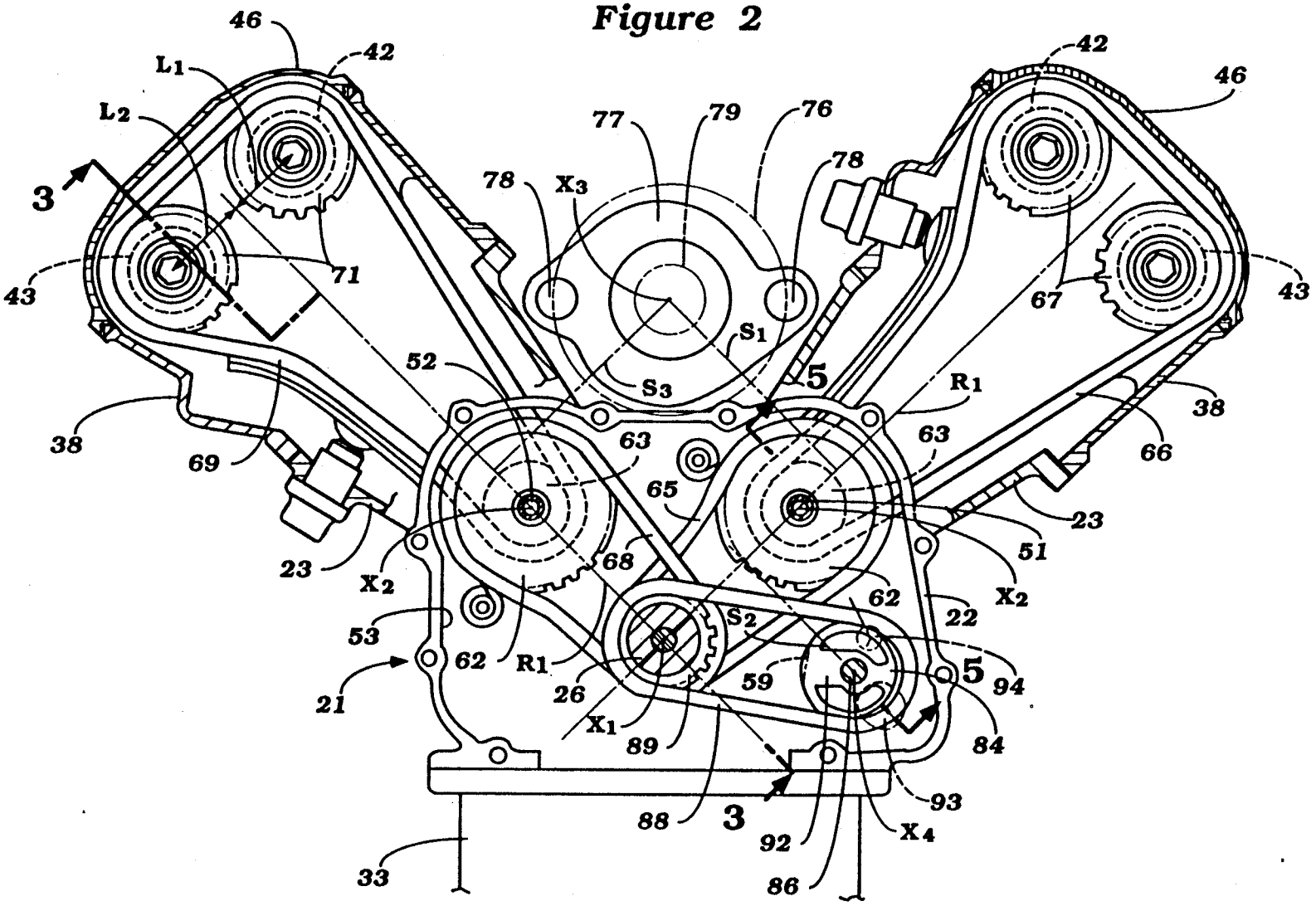
FIG. 2 is an enlarged front elevational view of the engine, with the front covers removed so as to more clearly show the mechanism for driving the camshafts and oil pump.

A first chain 65 extends from the crankshaft sprocket 58 to the sprocket 62 of the sprocket assembly 61 associated with the shaft 51. A portion of the speed reduction of two to one is accomplished in this flight. A second chain 66 extends from the sprocket 63 to sprockets 67 affixed for rotation with the camshafts 42 and 43 of this cylinder bank. As has been noted, the cylinder banks are staggered relative to each other and the right hand cylinder bank, as viewed in FIG. 2, is staggered rearwardly from the left hand cylinder bank and this is why the sprocket 58 is used to drive the camshafts associated with the right hand cylinder bank.

In a similar manner, a chain 68 extends from the crankshaft sprocket 57 to the sprocket 62 associated with the shaft 52 for driving this sprocket. A second chain 69 extends from the sprocket 63 to sprockets 71 associated with the camshafts 42 and 43 of the left hand cylinder bank.

It should be noted that the distance between the axes $X_1$ and $X_2$ is substantially less than the distance between the crankshaft axis and the axes of rotation of the camshafts 42 and 43. Also, it should be noted that the camshaft 42 is spaced a closer distance $L_1$ to a plane $R_1$ containing the cylinder bore axis and the axes $X_1$ and $X_2$ than the distance $L_2$ between the axis of rotation of the exhaust camshaft 43 and this plane. Of course, other arrangements can be employed without deviating from the invention.

As may be best seen in FIGS. 1 and 3, a combined pulley, torsional vibration damper 72 is affixed to the front end of the crankshaft 26 where it extends beyond the front cover 54 by means of a key 73 and nut 74. This device drives a drive belt 75 which, in turn, drives a number of accessories including a water pump assembly, indicated generally by the reference numeral 76, and which is disposed in the valley defined between the cylinder banks 23 of the cylinder block 22. This water pump 76 has a drive pulley 77 which is driven by the backside of the belt 75 and discharges coolant into a pair of cooling inlets 78 (FIG. 9) formed in the valley of the engine between the cylinder banks 23 and 24. The inlets 78 distribute water to the respective cylinder banks through their cooling jackets and this water is then returned through a suitable return and is circulated through a radiator and thermostat assembly (not shown).

As may be best seen in FIG. 2, the pulley 76 is connected for rotation to an input shaft 79 of the water pump assembly which rotates about an axis $X_3$. The axis $X_3$ is disposed at the base of the V and is oriented so that a pair of perpendicular lines $S_1$ and $S_3$ from the planes $R_1$ containing the cylinder bore axes and the axis of rotation of the crankshaft 26 ($X_1$) and the axes of rotation of the intermediate shafts 51 and 52 ($X_2$) are disposed radially outwardly beyond the axes of rotation of these intermediate shafts ($X_2$). This permits a very compact assembly without interference and without adding significantly to the bulk of the engine.

The belt 75 also drives an alternator assembly 81 that is disposed above the water pump 76 for accessibility via a pulley 82 that is affixed to the alternator input shaft. A pair of idler pulleys 83 are mounted on the respective cylinder banks 23 for completing the tensioning of the belt 75 and directing its path.

In addition to the crankcase 33, the lubricating system for the engine includes an oil pump, indicated generally by the reference numeral 84 and shown in most detail in FIGS. 2, 3, 5 and 10. The oil pump 84 is, in the illustrated embodiment, of the trochoidal type and includes an inner rotor 85 that is affixed to a drive shaft 86. The drive shaft 86 has affixed to its forward end a sprocket 87 that is in mesh with a chain 88 which, in turn, is driven by a sprocket 89 which forms the final sprocket of the sprocket assembly 59 (FIG. 3). This sprocket section 89 is the forwardmost sprocket section of this assembly 59. It should be noted that the oil pump shaft 84 rotates about an axis $X_4$ that lies on a perpendicular line $S_2$ to the plane $R_1$ of the right cylinder bank and is spaced inwardly of the intermediate shaft 51 so as to further aid in the compactness of the assembly without adding to the bulk of the engine.

The inner rotor 85 cooperates with an outer rotor 91 and pump housing 92 so as to draw oil into a pump inlet opening 93 and discharge it from a pump outlet opening 94.

The oil pump inlet opening 93 communicates with an oil delivery passage 95 that extends along the length of the cylinder block 22 to its approximate midpoint where it is intersected by a drilled passageway 96 (FIGS. 7 and 10). The passageway 96 communicates with a vertically extending passageway 97 formed in one side of the crankcase 33 formed in a boss 98 thereof. The passageway 97, in turn, communicates with a horizontally extending passageway 99 formed in a further internal boss 101 of the crankcase 33. The passageway 99 extends to an oil well 102 that is formed in the base of the crankcase 33 and which is closed by an oil strainer 103. Hence, strained oil is drawn into the oil pump from the crankcase through the aforedescribed path.

The oil pump discharge opening 94 communicates with a main delivery passage 104 (FIGS. 5, 7 and 10) that extends down one side of the cylinder block 22 and which terminates in an annular groove 105 formed in an oil filter mounting base 106. This oil flows through the oil filter (not shown) and is delivered back to the block through a passageway 107. The passageway 107 communicates with a main oil gallery 108 (FIGS. 7, 9, 11 and 12). The main oil gallery 108 delivers oil to the main bearings through delivery passages 109 formed in the bearing webs 27. In addition, a pressure relief valve 111 is positioned at the end of the gallery 108 so as to limit the maximum pressure in the oil pressure system.

The intermediate shafts and specifically the sprocket assembly 61 is also lubricated from the main oil gallery 108 by means of passages 112 that extend through the cylinder block 22 and which terminate within the bores 56. The oil thus delivered to the bores 56 flows through delivery passages 113 (FIG. 4) so as to lubricate the sprockets 61.

The lubricating system for the remaining components of the engine may be considered to be conventional and, for that reason, it has not been illustrated and description of it is believed to be unnecessary.

It should be readily apparent from the foregoing description that an extremely compact engine assembly is possible due to the relationship of the camshaft, drive mechanism and accessory drive mechanism as aforedescribed. It is also be to understood that the foregoing description is that of a preferred embodiment of the invention, and that various changes and modifications may be made without departing from the spirit and scope of the invention, as defined by the appended claims.

We claim:

1. An internal combustion engine having a cylinder block with at least one cylinder bore, a piston reciprocating in said cylinder bore, a crankshaft journaled for rotation about an axis and driven by said piston, a cylinder head affixed relative to said cylinder block and closing said cylinder bore, a camshaft journaled for rotation relative to said cylinder head and operating at least one valve therein, an intermediate shaft rotatable about an axis and being driven by first drive means at one end of said engine from said crankshaft, second drive means for driving said camshaft from said intermediate shaft at said one end of said engine, said first and second drive means comprising flexibly transmitters comprising at least one chain, and a coolant pump for circulating coolant through an engine cooling jacket having an input shaft driven by said crankshaft at said one end of said engine by a flexible transmitter other than those of said first and second drive means, said intermediate shaft axis of rotation lying closer to the axis of rotation of said crankshaft than said coolant pump input shaft.

2. An internal combustion engine as set forth in claim 1 further including a second camshaft journaled for rotation about an axis relative to the cylinder head and operating one additional valve therein, the first and second camshafts being driven by the second drive means.

3. An internal combustion engine having a cylinder block with at least one cylinder bore, a piston reciprocating in said cylinder bore, a crankshaft journaled for rotation about an axis and driven by said piston, a cylinder head affixed relative to said cylinder block and closing said cylinder bore, a camshaft journaled for rotation relative to said cylinder head and operating at least one valve therein, an intermediate shaft rotatable about an axis and being driven by first drive means at one end of said engine from said crankshaft, second drive means for driving said camshaft from said intermediate shaft at said one end of said engine, an accessory having an input shaft driven by said crankshaft at said one end of said engine, said intermediate shaft axis of rotation lying closer to the axis of rotation of said crankshaft than said accessory input shaft, and a further accessory driven by said engine at the one end thereof and disposed closer to the axis of rotation of said crankshaft than said intermediate shaft.

4. An internal combustion engine as set forth in claim 3 wherein the first and second accessories have their axes of rotation disposed on opposite sides of a plane containing the axis of the rotation of the intermediate shaft and the axis of rotation of the crankshaft.

5. An internal combustion engine as set forth in claim 4 wherein the first mentioned accessory comprises a coolant pump for circulating coolant through the engine and the second mentioned accessory comprises an oil pump for pumping lubricant to the engine.

6. An internal combustion engine having a cylinder block with at least a pair of angularly disposed cylinder bores disposed at a V angle to each other and defining a valley therebetween, pistons reciprocating within said cylinder bores and driving a crankshaft rotatable about an axis disposed at one end of said cylinder bores, a pair of cylinder heads each affixed relative to said cylinder block and closing a respective one of said cylinder bores, first and second camshafts each journaled for rotation relative to a respective one of said first and second cylinder heads for operating at least one valve contained therein, a pair of intermediate shafts rotatable about axes parallel to the axis of rotation of said crankshaft and said camshafts, first drive means for driving each of said intermediate shafts from said crankshaft, a pair of second drive means for driving each of said camshafts from a respective one of said intermediate shafts, the axis of rotation of said intermediate shafts being disposed closer to the axis of rotation of said crankshaft than to the axes of rotation of said camshafts, and an accessory disposed in said valley and having an input shaft driven from the crankshaft by third drive means, said first, second and said third drive means all being located at the same end of said engine, the axis of rotation of said accessory being spaced further from the axis of rotation of the crankshaft than the axis of rotation of the intermediate shafts.

7. An internal combustion engine as set forth in claim 6 further including a further accessory driven by fourth drive means and disposed outside of the valley of the V.

8. An internal combustion engine as set forth in claim 6 wherein the first drive means comprises a pair of flexible transmitters each driving a respective one of the intermediate shafts.

9. An internal combustion engine as set forth in claim 8 wherein there are provided third and fourth camshafts rotatably journaled relative to the first and second cylinder heads, respectively, and operating further valves therein, said first and said third and said second and said fourth camshafts being driven by the respective of the pair of second drive means.

10. An internal combustion engine as set forth in claim 9 further including a further accessory driven by fourth drive means and disposed outside of the valley of the V.

* * * * *